US007990031B2

(12) United States Patent
Lu

(10) Patent No.: US 7,990,031 B2
(45) Date of Patent: Aug. 2, 2011

(54) LIGHT EMITTING DIODE LAMP

(75) Inventor: Yi-Da Lu, Taichung (TW)

(73) Assignee: Darfon Electronics Corp., Taoyuan (TW)

( * ) Notice: Subject to any disclaimer, the term of this patent is extended or adjusted under 35 U.S.C. 154(b) by 28 days.

(21) Appl. No.: 12/651,699

(22) Filed: Jan. 4, 2010

(65) Prior Publication Data

US 2010/0181888 A1 Jul. 22, 2010

(30) Foreign Application Priority Data

Jan. 20, 2009 (TW) ..... 98201038 U

(51) Int. Cl.
*H01J 7/24* (2006.01)
*H01J 61/52* (2006.01)
*F21V 29/00* (2006.01)

(52) U.S. Cl. ..... 313/46; 313/512; 362/373; 362/294; 362/255; 362/800; 362/218; 362/264

(58) Field of Classification Search ..... None
See application file for complete search history.

(56) References Cited

U.S. PATENT DOCUMENTS

| | | | | |
|---|---|---|---|---|
| 6,499,860 | B2 * | 12/2002 | Begemann | 362/230 |
| 7,387,403 | B2 * | 6/2008 | Mighetto | 362/218 |
| 7,575,346 | B1 * | 8/2009 | Horng et al. | 362/373 |
| 7,581,856 | B2 * | 9/2009 | Kang et al. | 362/373 |
| 7,837,363 | B2 * | 11/2010 | Liu | 362/373 |
| 2005/0036317 | A1 * | 2/2005 | Niskanen | 362/294 |
| 2010/0027270 | A1 * | 2/2010 | Huang et al. | 362/310 |

* cited by examiner

*Primary Examiner* — Ashok Patel
(74) *Attorney, Agent, or Firm* — WPAT, PC; Justin King

(57) ABSTRACT

A light emitting diode (LED) lamp is disclosed, which comprises: a base; a tube, mounted on the base and configured with a plurality of first openings; a mask, for receiving a portion of the tube inside the same and being configured with a plurality of second openings; a plurality of light emitting diodes (LEDs), each being mounted at the exterior periphery of the tube; and a fan, being arranged connecting to the tube; wherein, the operation of the fan is going to cause air convention between the tube and the mask for dissipating the heat generated from the LEDs with high efficiency.

19 Claims, 7 Drawing Sheets

200a

200a

200b

200c

300

300

300a

LIGHT EMITTING DIODE LAMP

FIELD OF THE INVENTION

The present invention relates to a light emitting diode (LED) lamp, and more particularly, to a LED lamp with high heat dissipating efficiency.

BACKGROUND OF THE INVENTION

In the field of lighting, light-emitting diodes (LEDs), being an highly efficient light emitting device capable of converting electricity into light, are becoming more and more popular because they presents many advantages including lower energy consumption, longer lifetime, faster switching, and greater durability and reliance. Although many conventional lighting devices still adopt incandescent lights as their light sources, there are already many lighting devices using LEDs instead of incandescent lights as their light sources so as to avoid the disadvantages resulting from the incandescent lights, such as short lifetime, low light emitting efficiency, environmentally unfriendly, and so on.

Please refer to FIG. 1, which is a cross sectional view of a conventional LED lamp. As shown in FIG. 1, the conventional LED lamp 100 is comprised of: a base 110, a heat conducting column 120, a mask 130 and a plurality of LEDs 140. The plural LEDs are mounted on the heat conducting column 120 for emitting light while the heat conducting column 120 is fixedly mounted on the base 110 by an end thereof to be used for conducting heat generated from the LEDs to the exterior of the LED lamp 100. In addition, the mask 130 is engaged to the base 110 while enabling the heat conducting column 120 and the LEDs 140 to be received therein.

However, only by the use of the heat conducting column 120, it is not able to conduct all the heat generated from the LEDs 140 immediately out of the LED lamp 100, and thus the lighting efficiency of the LED lamp 100 will be greatly reduced by overheating. Although there are already many conventional LED lamps had been configured with additional fan 150 for improving heat conducting efficiency, the improvement is still not significant since the conventional fan arrangement is not able to achieve air convention in the LED lamp.

Moreover, since the heat conducting column 120 is usually a pricey solid copper block, the resulting high manufacturing cost is going to cause the market commercial competitiveness of the LED lamps to drop.

SUMMARY OF THE INVENTION

In view of the disadvantages of prior art, the primary object of the present invention is to provide a light emitting diode (LED) lamp not only with improved heat dissipating efficiency, but capable of being manufactured with comparatively lower cost.

To achieve the above object, the present invention provides a light emitting diode (LED) lamp, comprising: a base; a tube, mounted on the base and configured with a plurality of first openings; a mask, for receiving a portion of the tube inside the same and being configured with a plurality of second openings; a plurality of light emitting diodes (LEDs), each being mounted at the exterior periphery of the tube; and a fan, being arranged connecting to the tube; wherein, the operation of the fan is going to cause air convention between the tube and the mask for dissipating the heat generated from the LEDs with high efficiency.

In an embodiment of the invention, the fan can either be arranged inside the tube, or be mounted on the tube at an end thereof opposite to the base.

In an embodiment of the invention, the mask is disposed connecting to the base while enabling all the tube to be received inside the mask.

In an embodiment of the invention, the mask is connected to the tube while enabling a portion of the tube to be received inside the mask.

In an embodiment of the invention, the LED lamp further comprises: a heat dissipating plate, being configured connected to the base. It is noted that the heat dissipating plate can be formed as a heat dissipating fin that is designed for increasing the heat dissipating area of the LED lamp. Moreover, the heat dissipating plate can be made of aluminum alloy with enhance heat conducting efficiency.

To sum up, by the arranging of the plural first holes and second holes in the LED lamp as well as the operation of the fan, air convention can be caused between the tube and the mask so as to dissipate the heat generated from the LEDs with high efficiency.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 2A:
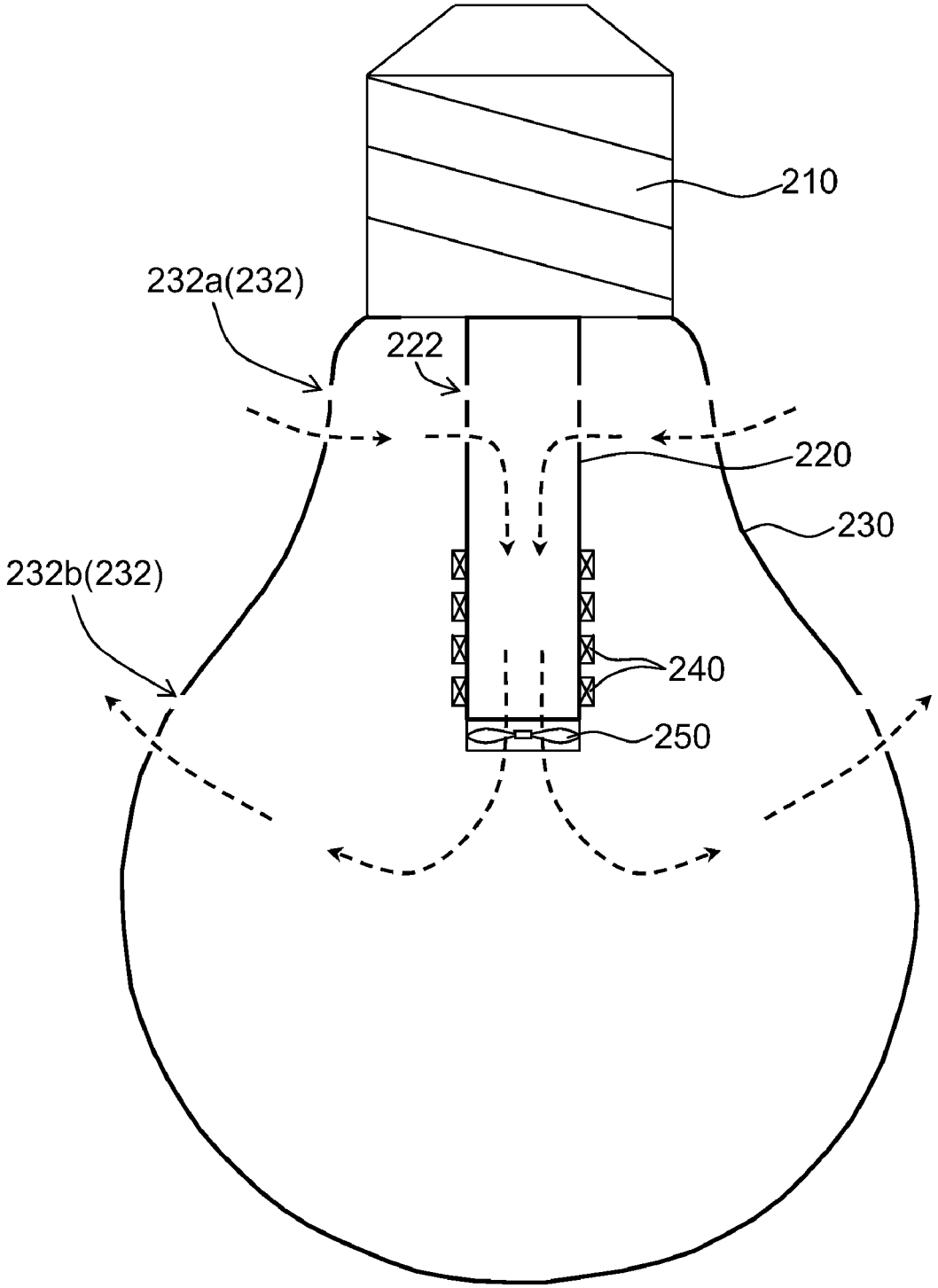
FIG. 2A to FIG. 2C are cross sectional views of three LED lamps according to three different embodiments of the invention.

Please refer to FIG. 2A, which is a cross sectional views of a LED lamp according to an embodiments of the invention. In FIG. 2A, a LED lamp 200*a* of the invention is comprised of: a base 210, a tube 220, a mask 230, a plurality of LEDs 240 and a fan 250, in which the tube 220, being mounted on the base 210 and having a portion thereof received inside the mask 230, is configured with a plurality of first openings 222; and the plural LEDs 240, being mounted at the exterior periphery of the tube 220, is used for generating light; and the mask 230 is configured with a plurality of second openings 232. It is noted that the forming of the first openings 222 and the second openings 232 is for enabling the air in the tube 220 and the mask 230 to communicate with the outside of the LED lamp 200*a*. In addition, the fan 250 being arranged connecting to the tube 220, is used for producing airflow so as to enable the heat from the LEDs 240 to be dissipated accordingly.

Operationally, the operating fan 250 will draw the outside air to flow into the mask 230 through the second openings 232*a* flowing a path indicated by the dotted arrow shown in FIG. 2A, and then into the tube 220 through the first openings 222. Since the heat generated from the LEDs 240 will be conducted to the tube 220 rapidly, it can be carried away and thus dissipated by the flowing air as soon as the flowing air comes into contact with the sidewall of the tube 220. Thereafter, the heated air will be discharged out of the tube 220 and then into the mask 230 where it is further being discharged out of the lamp 200*a* through the second openings 232*b*, by that an air convention is achieved and thus greatly improves the heat dissipating for the LEDs.

Figure 2B:
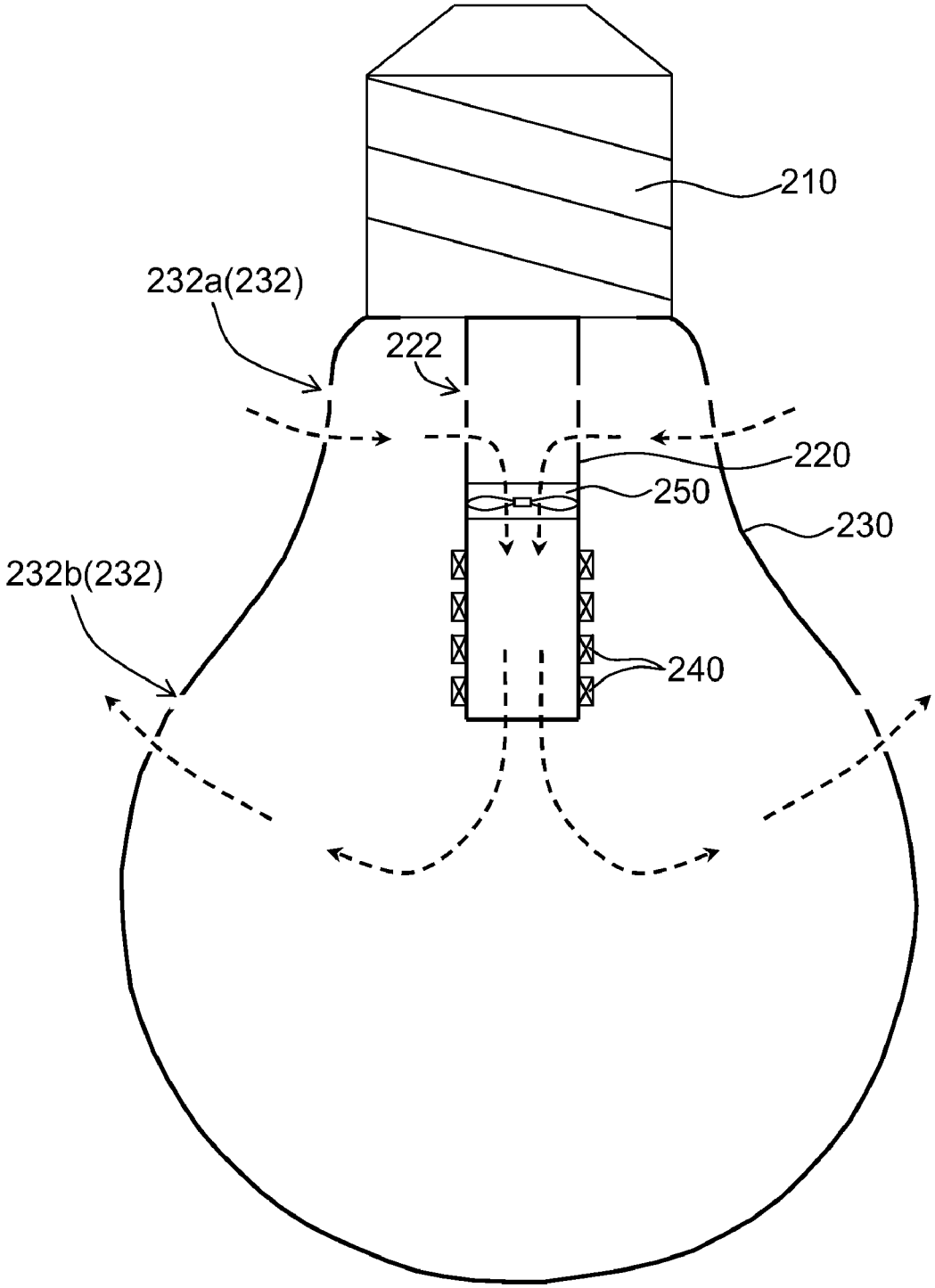

In the present embodiment, the fan 250 is fixedly secured to an end of the tube 220 opposite to the base 210. However, the arrangement of the fan 250 is not limited thereby. In another embodiment, the fan can be arranged inside the tube 220, as the LED lamps 200*b* shown in FIG. 2B. In addition, the fan 250 can be arranged to rotate clockwisely for drawing air into the LED lamp or to rotate counterclockwisely for discharging air out of the LED lamp. Nevertheless, if the fan 250 is arranged to rotate counterclockwisely for discharging air out of the LED lamp, the resulting air flow will be reverse to the one disclosed in the foregoing description, that is known to those skilled in the art and thus will not be described further herein.

In the LED lamp 200*a* shown in FIG. 2A, the mask can be made of a transparent material, such as glass. In addition, the mask 230 is engaged with the base 210 by clipping while enabling the tube 220 to be received inside the mask completely. However, in another embodiment of the invention, the mask 230 is also being engaged with the base 210 by clipping, but allowing a portion of the tube to be exposed outside the mask 220, as the LED lamp 200*c* shown in FIG. 2C.

Figure 2C:
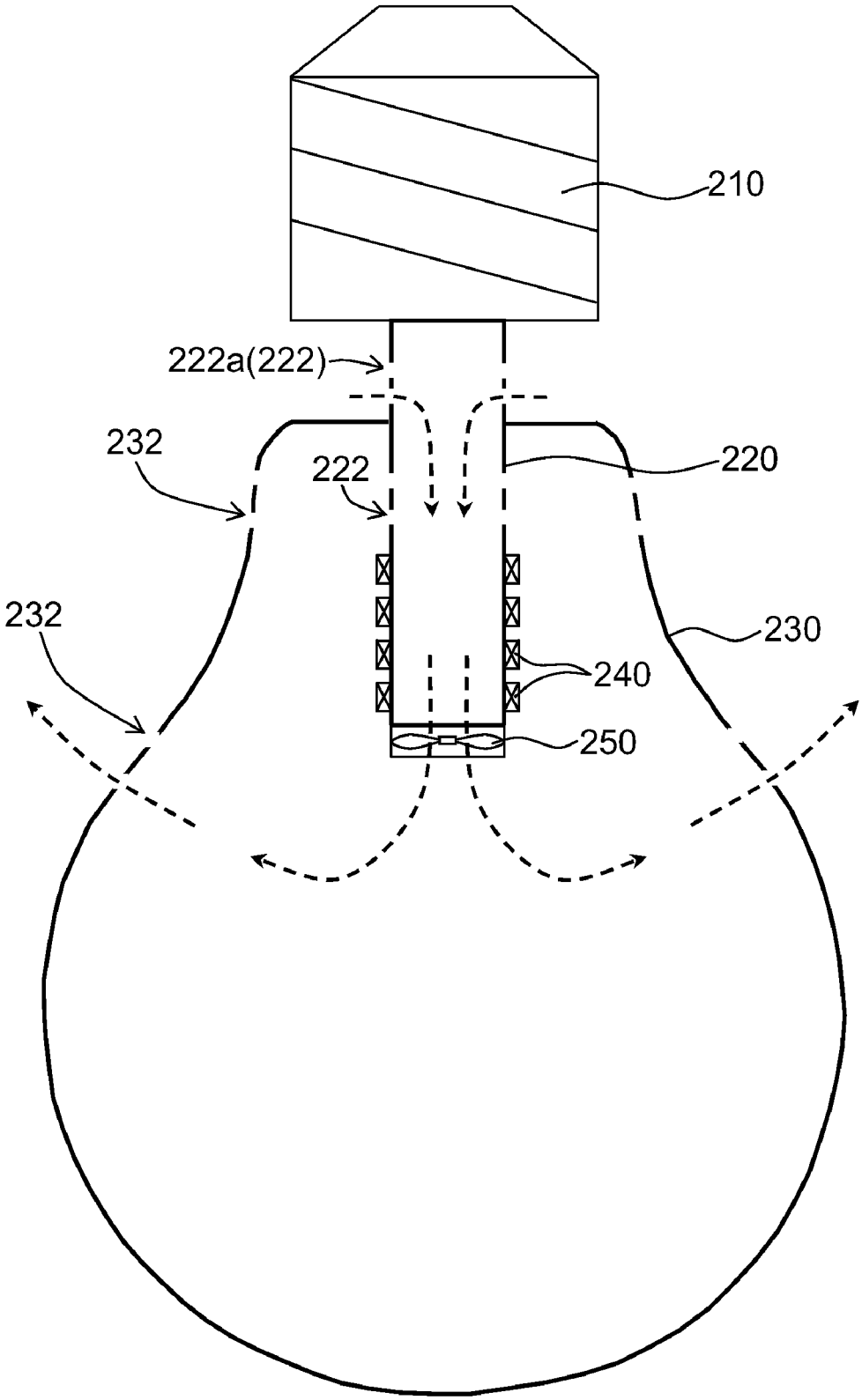

In the embodiment shown in FIG. 2C, the first openings 222*a* are formed on the tube 220 at the portion thereof exposed outside the mask 230, so that the fan 250 is able to draw air to flow into the tube 220 directly through the first openings 222*a* for achieving a better heat dissipating efficiency.

Figure 1:
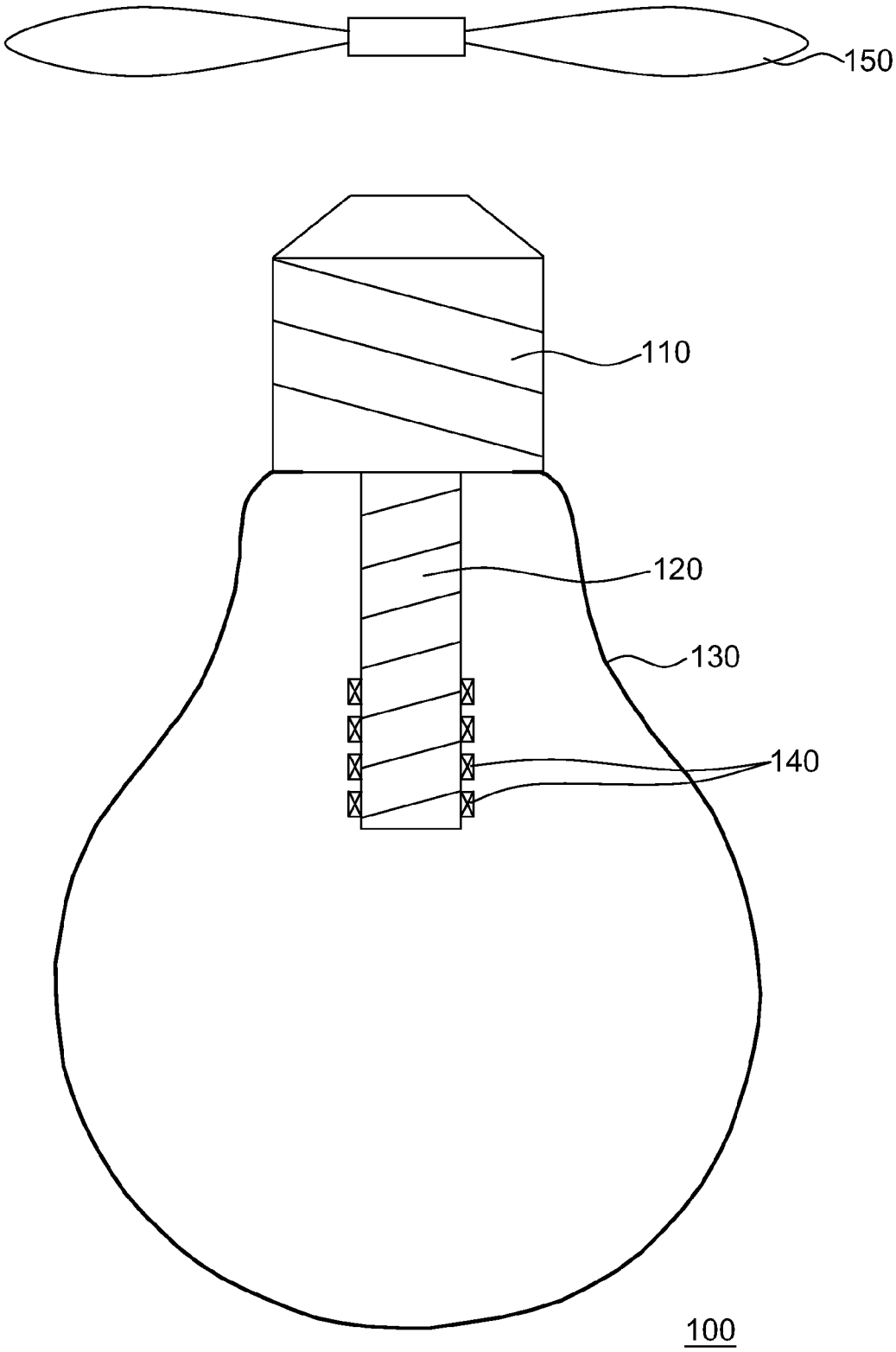
FIG.1(Prior Art)
FIG. 1 is a cross sectional view of a conventional LED lamp.

Moreover, the tube 220 in the LED lamp 200*a* of FIG. 2A can be made of a material of high heat conductivity, such as aluminum alloys or ceramics. In addition, the tube 220 is constructed as a hollow structure, which is cheaper comparing with the solid heat conducting column shown in FIG. 1, and thus the manufacturing cost of the LED lamp 200*a* is reduced.

Furthermore, in order to increase the contact area between the tube 220 and the airflow for further enhancing the heat dissipating efficiency, the tube 220 can be further configured with a plurality of fins, or can have a plurality of grooves on its inner sidewall and/or outer sidewall. It is noted that there can be a variety of modifications relating to the increasing of the contact area of the tube 220, and thus it is not limited by the two described hereinbefore.

Despite of the first openings 222 are formed on the upper half of the tube 220 and the second openings 232 are formed on the upper half of the mask 230 at positions close to the middle thereof so as to function in cooperation with the fan 25 for achieving air convention, the positioning of the first openings as well as the second openings are not limited thereby. For instance, the second openings 232 can be formed at the lower half of mask 230 in positions corresponding to the fan 250, so that the heated air being drawn out of the tube 220 by the fan 250 can be discharged out of the LED lamp through those second openings 232 at the lower half of the mask 230.

In this embodiment, the base 210 is configured according to the E26/E27 specification, which is the same as those conventional incandescent lights. In addition, there can be a plurality of wires for electrically connecting the base 210 with the LEDs 240 and the fan 250, buy that the electricity received by the base 210 can be transmitted to the LEDs 240 and the fan 250 for activating the same.

Figure 3A:
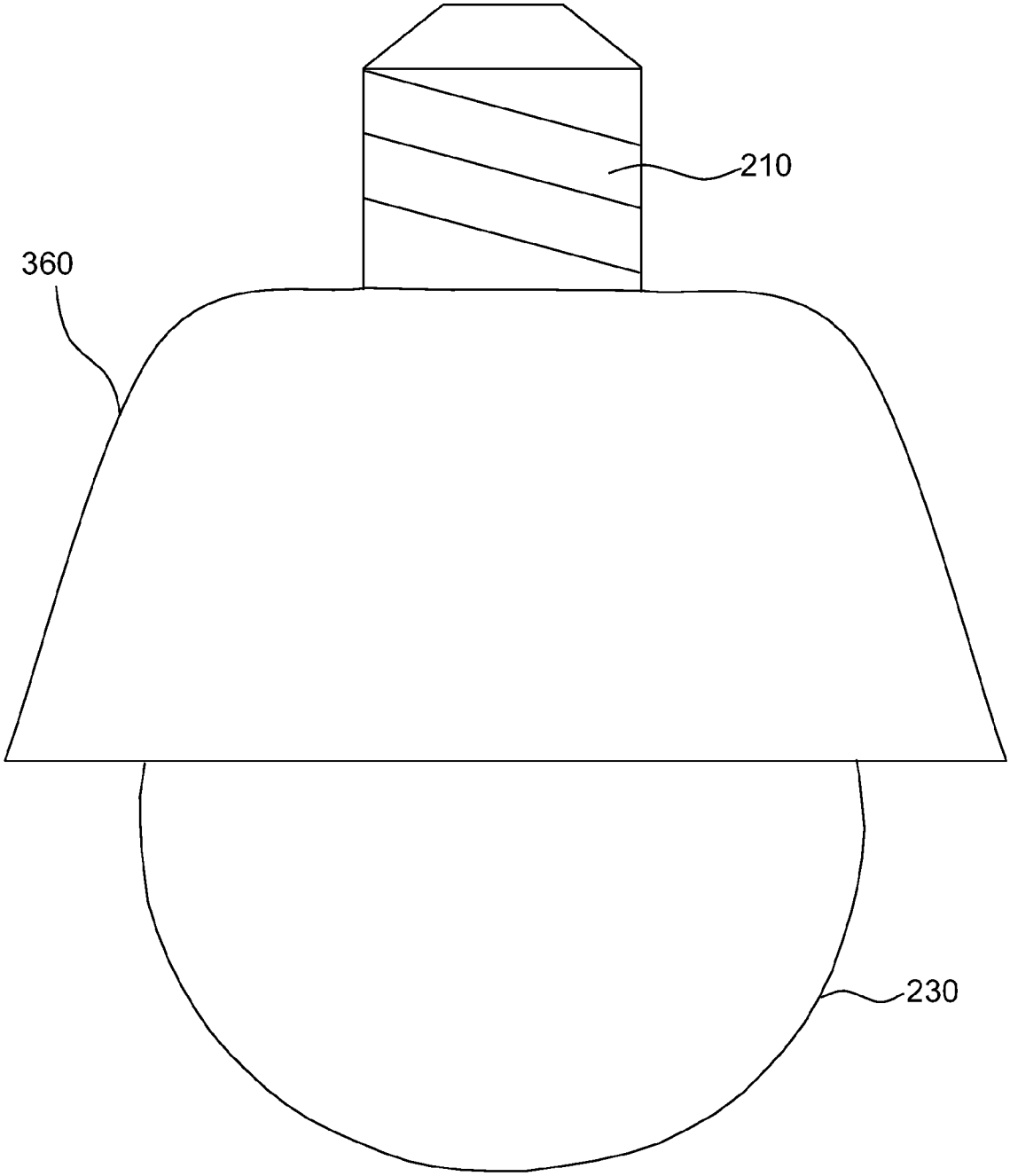
FIG. 3A is a cross sectional view of a LED lamp according to another embodiment of the invention.
Figure 3B:
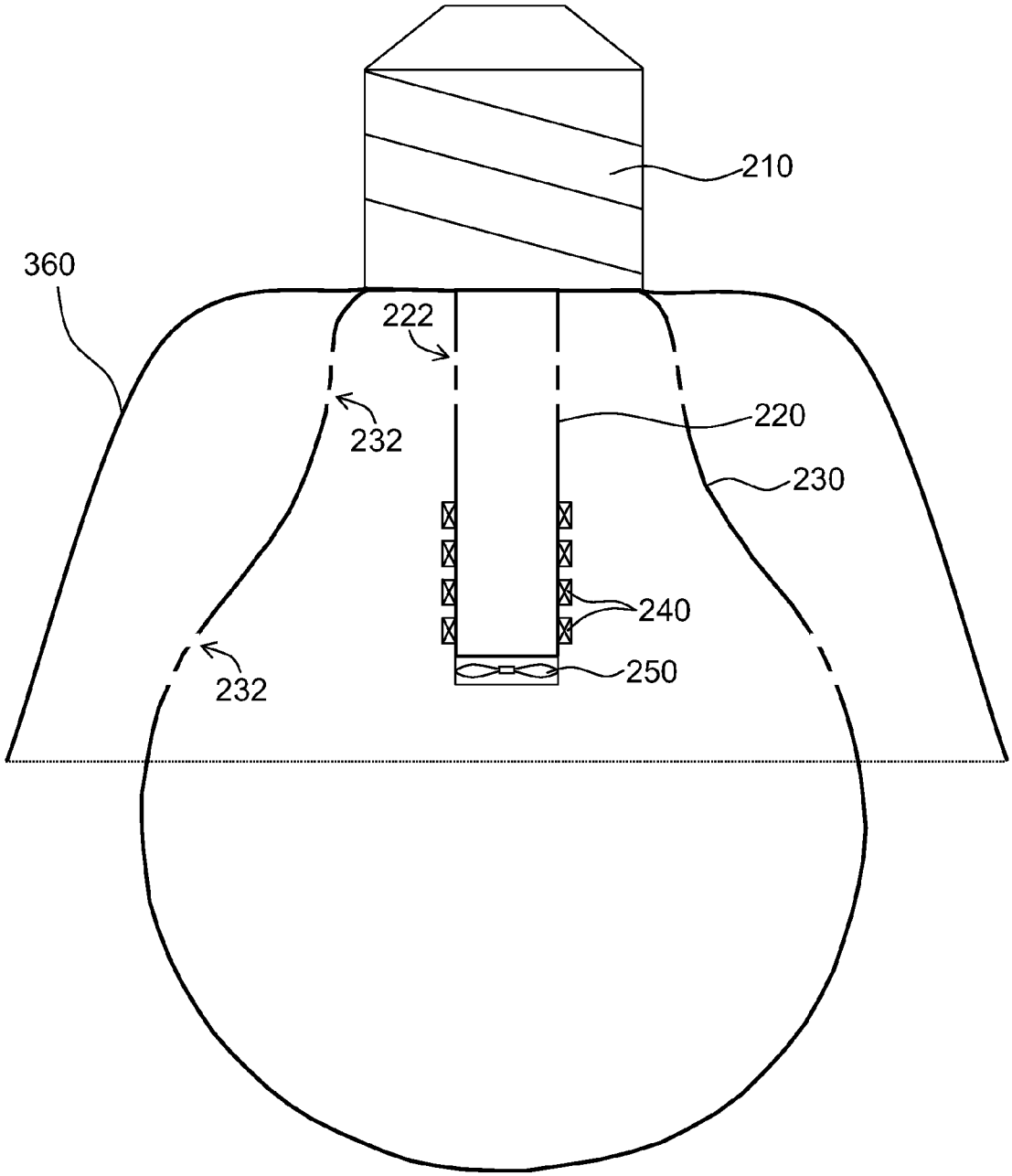
FIG. 3B is a side view of the LED lamp shown in FIG. 3A.

Please refer to FIG. 3A and FIG. 3B, which shows a LED lamp according to another embodiment of the invention. In this embodiment, the LED lamp 300 is constructed almost the same as the LED lamp 200*a* shown in FIG. 2A, but is different in that: the LED lamp 300 is further configured with a heat dissipating plate 360 for improving the heat dissipating of its LEDs 240, whereas the heat dissipating plate 360 is fitted to the base 210 for enabling the heat generated from the LEDs 240 to be transmitted rapidly from to the heat dissipating plate 360 through the conduction of the tube 220 and the base 210. Thus, the heat dissipating effect is improved since the heat dissipating plate 360 can provide additional heat dissipating area for the LED lamp 300.

Similarly, the heat dissipating plate 360 can be formed as a heat dissipating fin, or can have a plurality of grooves being formed on its surface for increasing its surface area. In addition, the heat dissipating plate 360 can be made of material of high heat conductivity, such as aluminum alloys. Moreover, the surface of the heat dissipating plate 360 can be treated with a micro arc oxidation (MAO) process so that it is insulated for preventing user from getting an electric shock by accident.

In the embodiment shown in FIG. 3A and FIG. 3B, there is a reflection layer being formed on the inner surface of the heat dissipating plate that is facing toward the LEDs 240. Thereby, the portion of light from the LEDs 240 that is being emitted horizontally or upwardly will be reflected by the reflection layer for redirecting the same to travel downward, so that all the light from the LEDs 240 are concentrated and thus the usage efficiency of the LEDs 240 are enhanced. It is noted that the heat dissipating plate 360 in the present invention can be formed in any shape only if it is in a shape for facilitating the light concentration of the reflection layer, such as paraboloid, or ellipse, etc.

Figure 3C:
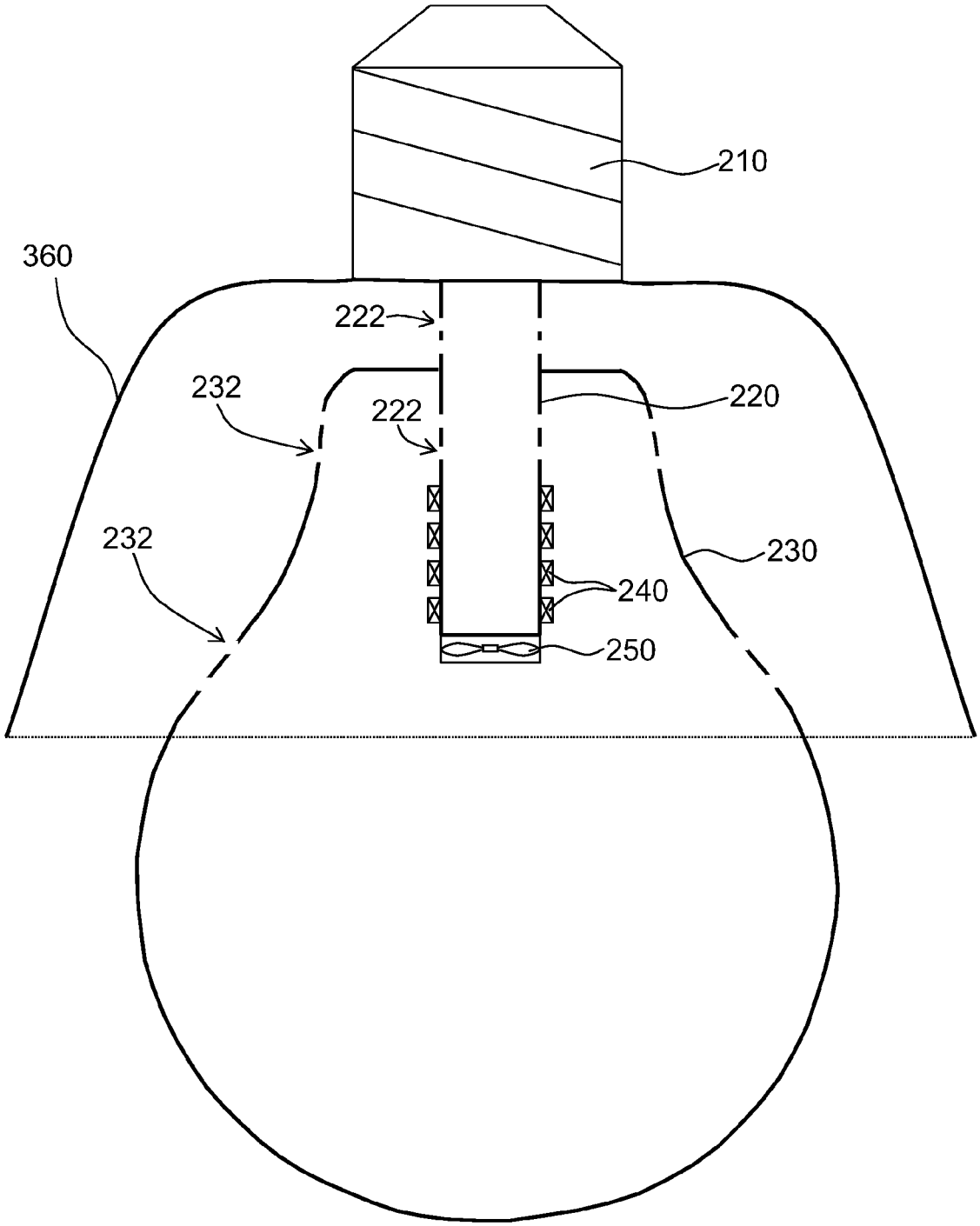
FIG. 3C is a cross sectional view of a LED lamp according to further another embodiment of the invention.

Although, in the embodiment shown in FIG. 3A and FIG. 3B, the mask 230 is connected to the heat dissipating plate, the mask 230 can be connected to the tube instead, as the LED lamp 300*a* shown in FIG. 3C. Accordingly, it is known to those skilled in the art that the mask 230 can be connected to the base 210, or to the tube 220, or to the heat dissipating plate 360 at will without limitation.

To sum up, the LED lamp of the invention at least has the following advantages:

(1) By the arranging of the plural first holes and second holes in the LED lam, air convention can be caused so as to dissipate the heat generated from the LEDs with high efficiency.

(2) By constructing the tube as a hollow structure, the overall manufacturing cost of the LED lamp is reduced.

(3) By the arrangement of the heating dissipating plate and the reflection layer, not only the heat dissipating efficiency is further improved, but also the light source usage efficiency of the LED lamp is enhanced.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A light emitting diode (LED) lamp, comprising:

a base;

a tube, mounted on the base and configured with a plurality of first openings;

a mask, for receiving a portion of the tube inside the same and being configured with a plurality of second openings;

a plurality of light emitting diodes (LEDs), each being mounted at the exterior periphery of the tube;

a fan, being arranged connecting to the tube; and a heat dissipating plate, being disposed connecting to the base.

2. The LED lamp of claim 1, wherein the fan is arranged inside the tube.

3. The LED lamp of claim 1, wherein the fan is mounted on the tube at an end thereof opposite to the base.

4. The LED lamp of claim 1, wherein the mask is connected to the base.

5. The LED lamp of claim 4, wherein the tube is arranged completely inside the mask.

6. The LED lamp of claim 1, wherein the mask is connected to the tube while enabling a portion of the tube to be received inside the mask.

7. The LED lamp of claim 1, further comprising:

a reflection layer, disposed on a surface of the heat dissipating plate facing toward the plural LEDs.

8. The LED lamp of claim 1, wherein the heat dissipating plate is substantially a heat dissipating fin.

9. The LED lamp of claim 1, wherein the heat dissipating plate is made of an aluminum alloy.

10. The LED lamp of claim 1, wherein the mask is connected to the heat dissipating plate.

11. The LED lamp of claim 1, wherein the mask is connected to the tube.

12. A light emitting diode (LED) lamp, comprising:

a base;

a tube, mounted on the base and configured with a plurality of first openings;

a mask, for receiving a portion of the tube inside the same and being configured with a plurality of second openings;

a plurality of light emitting diodes (LEDs), each being mounted at the exterior periphery of the tube; and a fan, being arranged connecting to the tube;

wherein the mask is connected to the tube while enabling a portion of the tube to be received inside the mask.

13. The LED lamp of claim 12, wherein the fan is arranged inside the tube.

14. The LED lamp of claim 12, wherein the fan is mounted on the tube at an end thereof opposite to the base.

15. The LED lamp of claim 12, wherein the mask is connected to the base.

16. The LED lamp of claim 15, wherein the tube is arranged completely inside the mask.

17. The LED lamp of claim 12, further comprising:

a heat dissipating plate, being disposed connecting to the base.

18. The LED lamp of claim 17, wherein the heat dissipating plate is substantially a heat dissipating fin.

19. The LED lamp of claim 17, further comprising:

a reflection layer, disposed on a surface of the heat dissipating plate facing toward the plural LEDs.

* * * * *